US006088464A

United States Patent [19]

Oshino

[11] Patent Number: 6,088,464

[45] Date of Patent: Jul. 11, 2000

[54] ACOUSTIC PIEZOELECTRIC VIBRATOR AND LOUDSPEAKER USING THE SAME

[75] Inventor: Kiyota Oshino, Yonezawa, Japan

[73] Assignee: Shinsei Corporation, Yamagata, Japan

[21] Appl. No.: 09/091,791

[22] PCT Filed: Oct. 23, 1997

[86] PCT No.: PCT/JP97/03854

§ 371 Date: Jun. 24, 1998

§ 102(e) Date: Jun. 24, 1998

[87] PCT Pub. No.: WO98/18291

PCT Pub. Date: Apr. 30, 1998

[30] Foreign Application Priority Data

| | | | |
|---|---|---|---|
| Oct. 24, 1996 | [JP] | Japan | 8-10808 |
| Jun. 19, 1997 | [JP] | Japan | 9-162939 |
| Jun. 19, 1997 | [JP] | Japan | 9-162957 |

[51] Int. Cl.[7] ..... H04R 25/00

[52] U.S. Cl. ..... 381/190; 381/398; 310/324

[58] Field of Search ..... 381/114, 173, 381/190, 191, 398, 353, 354, 182, 186; 310/324; 181/171, 172, 173

[56] References Cited

FOREIGN PATENT DOCUMENTS 0182999 10/1983 Japan ..... 381/190

*Primary Examiner*—Huyen Le
*Attorney, Agent, or Firm*—Kenyon & Kenyon

[57] ABSTRACT

In a piezoelectric vibrator used for acoustic equipment, a vibration control piece composed of an elastomer is attached to the peripheral section of the piezoelectric plate of the vibrator. The shape of the vibration control plate is decided so that the distance between an axial line which is perpendicular to the straight line connecting the center of the piezoelectric plate to the center of gravity of the vibration control piece and passing through the center of the plate and the center-of-mass line of the vibration control plate can change along the axial line, or the masses of the cut pieces of the vibration control plate cut along a plurality of straight lines parallel to the straight line connecting to the center of the piezoelectric plate to the center of gravity of the vibration control piece can change along the axial line which is perpendicular to the straight line and passes through the center of the piezoelectric plate.

8 Claims, 10 Drawing Sheets

ACOUSTIC PIEZOELECTRIC VIBRATOR AND LOUDSPEAKER USING THE SAME

TECHNICAL FIELD

The present invention relates to a piezoelectric oscillator used as a sound source for an acoustic apparatus such as a speaker, and a speaker using the acoustic piezoelectric oscillator.

BACKGROUND ART

Various acoustic apparatuses such as speakers or others have been known in the prior art, wherein a piezoelectric oscillation plate, for example, a bimorph cell, is used as a sound source. Although the piezoelectric oscillation plate is excellent particularly in treble characteristics, resonance is liable to occur in the piezoelectric oscillation plate at a certain frequency to cause a peak, whereby the prior art fails to have a flat characteristic over a wide range of frequencies.

Also, there is a problem in that the movement of the piezoelectric oscillation plate is small, whereby it is difficult to sufficiently increase a sound pressure in a bass range by using the piezoelectric oscillation plate.

DISCLOSURE OF THE INVENTION

An object of the present invention is to solve the problems in the prior art.

To achieve the above object, according to the present invention, a piezoelectric oscillator wherein an oscillation controlling piece of elastomer is attached to the periphery of a piezoelectric oscillation plate is provided, and the piezoelectric oscillator is characterized in that the oscillation controlling piece is shaped so that the distance between an axis passing through a center of the piezoelectric oscillation plate, which is perpendicular to a straight line connecting a center of the piezoelectric oscillation plate to the center of gravity of the oscillation controlling piece, and a mass center line of the oscillation controlling piece varies along the axis.

According to another aspect of the present invention, a piezoelectric oscillator wherein an oscillation controlling pieces of elastomer is attached to the periphery of a piezoelectric oscillation plate is provided, and the piezoelectric oscillator is characterized in that the oscillation controlling piece is shaped so that a mass of each section of the oscillation controlling piece divided by a plurality of straight lines parallel to a straight line connecting a center of the piezoelectric oscillation plate to the center of gravity of the oscillation controlling piece varies along an axis which is perpendicular to the straight line and passes through the center of the piezoelectric oscillation plate.

The piezoelectric oscillator may be covered with a piezoelectric element layer generally all over each of the opposite surfaces of a metallic disk.

The piezoelectric oscillator may be covered with a piezoelectric element layer generally all over each of the opposite surfaces of a metallic disk.

According to a further aspect of the present invention, a speaker is provided wherein a dynamic speaker for a bass sound and an acoustic oscillation plate for generating medium and treble sounds are accommodated in a speaker box, and the acoustic oscillation plate is made to vibrate by a piezoelectric oscillation plate. In this speaker, the bass sound is allotted to the dynamic speaker and the medium and treble sound to the acoustic oscillation plate driven by the piezoelectric oscillation plate.

Preferably, the acoustic oscillation plate is a thin-walled flat plate held by the speaker box via an elastic member, and carries the piezoelectric oscillation plates on a back surface thereof with a space between each plate.

In addition, the piezoelectric oscillators may be arranged on the back surface of the acoustic oscillation plate and overlapped with each other.

BEST MODE FOR CARRYING OUT THE INVENTION

Figure 1:
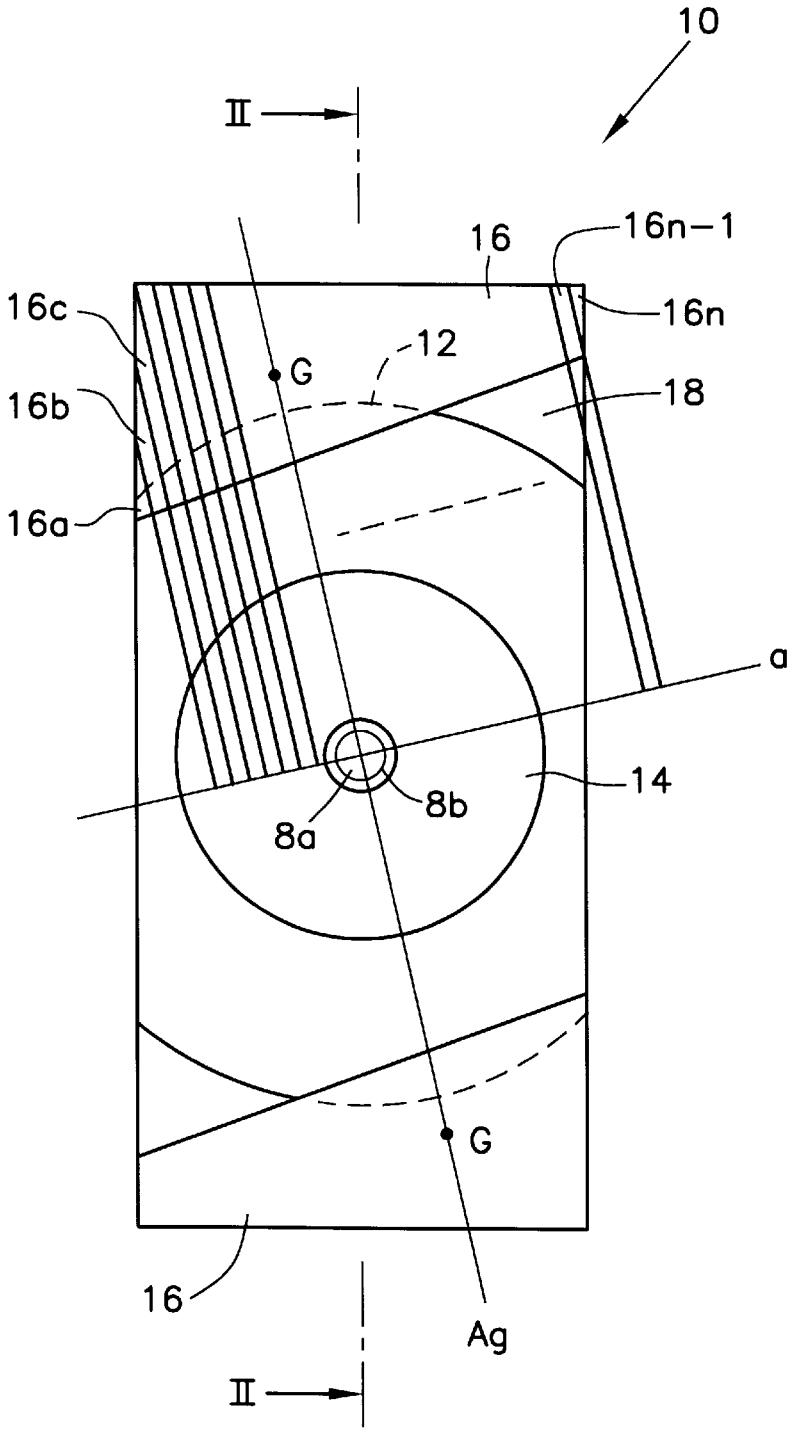
FIG. 1 is a plan view of a piezoelectric oscillator according to a first embodiment of the present invention.
Figure 2:
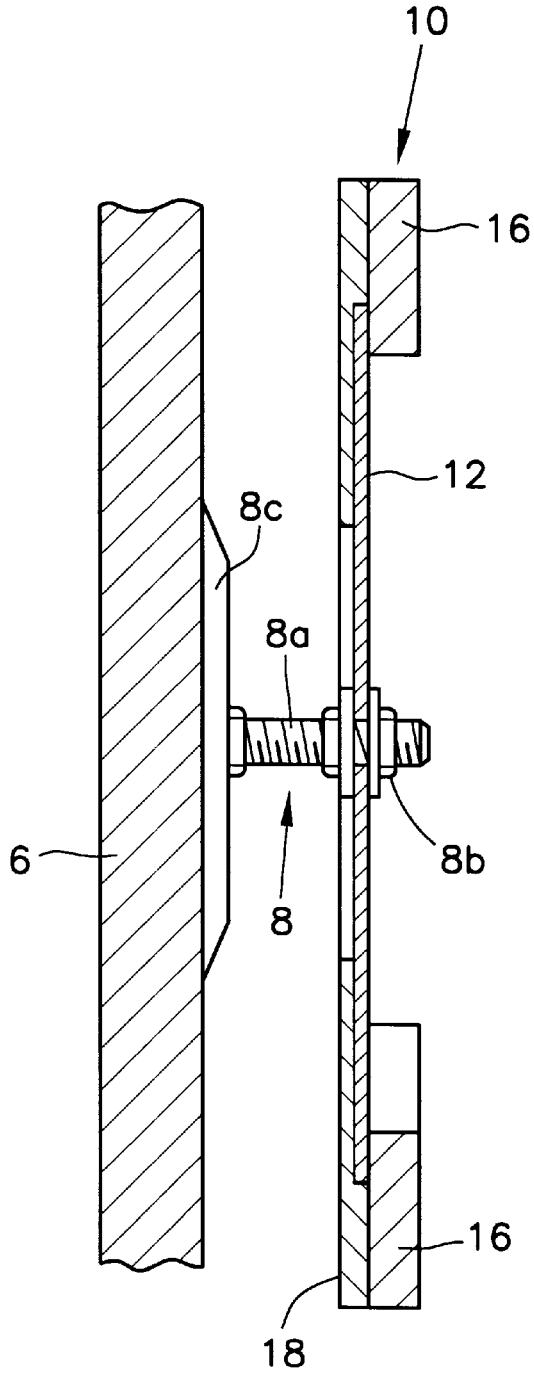
FIG. 2 is a sectional view of the piezoelectric oscillator attached to an acoustic oscillation plate of a speaker, taken along a line II—II in FIG. 1.

With reference to FIGS. 1 and 2, a piezoelectric oscillator 10 according to a first embodiment of the present invention includes a piezoelectric oscillating plate 12 carrying a piezoelectric element layer 14 (not shown in FIG. 2) on each of the opposite surfaces thereof. When electric signals, corresponding to sounds, are applied to the piezoelectric oscillation plate 12, the piezoelectric oscillating plate 12 repeatedly bends back and forth in accordance with voltage levels of the electric signals. A central portion of the piezoelectric oscillation plate 12 is attached to an acoustic oscillation plate 6 via a mounting assembly 8 consisting of a rod 8*a,* a nut 8*b* and a bracket 8*c*. Preferably, the bracket 8*c* is secured to the acoustic oscillation plate 6 with a suitable adhesive or a double-coated tape.

In the embodiment shown in FIGS. 1 and 2, the piezoelectric oscillation plate 12 is of a shape wherein opposite side portions of a disk are cut off to be easily bent. Also, a pair of oscillation controlling pieces 16 are fixed to opposite ends of the piezoelectric oscillation plate 12. The oscillation controlling piece 16 is made of an elastic material, preferably an elastomer such as synthetic rubber, natural rubber, low-density polyethylene or non-rigid polyvinyl chloride. In this regard, in the embodiment shown in FIG. 1, a lamination structure 18 made of an elastomer similar to the oscillation controlling piece 16 is secured onto a surface of the piezoelectric oscillation plate 12 opposite to the surface to which the oscillation controlling pieces 16 are bonded. Preferably, the oscillation controlling piece 16 and the lamination structure 18 are adhered to the piezoelectric oscillation plate 12 with a suitable adhesive.

As described above, when the acoustic signal is applied to the piezoelectric oscillation plate 12, the piezoelectric plate 12 repeatedly bends back and forth. The oscillation controlling piece 16 functions as an inertial mass, when the piezoelectric oscillation plate 12 bends, to remain at the original position by an inertial force, whereby the central portion of the piezoelectric oscillation plate 12 displaces back and forth to vibrate the acoustic oscillation plate 6 via the rod 8*a*. The oscillation controlling piece 16 absorbs the vibration of the piezoelectric oscillation plate 12 to restrict the resonant action of the piezoelectric oscillation plate 12 so that a flat acoustic pressure level is obtainable.

The oscillation controlling piece 16 will be described in more detail with reference to FIG. 1. In FIG. 1, an axis "a" of the piezoelectric oscillator 10 passes through a center of the piezoelectric oscillation plate 12 and is perpendicular to another axis "$a_g$" connecting centers of gravity of the pair of oscillation controlling pieces 16 to each other. The oscillation controlling piece 16 has a trapezoidal configuration in FIG. 1, which can be considered a configuration in which, providing a plurality of imaginary micro-subsections 16*a*, 16*b*, . . . 16*n* which are divided by straight lines perpendicular to the axis "a", the mass of each micro-subsections changes along the "a". According to this construction, the pair of oscillation controlling pieces 16 function as if an infinite number of subsections having different masses suppress the vibration of the piezoelectric oscillation plate 12, whereby it is believed that various oscillation modes are controllable.

Although the embodiment shown in FIG. 1 has a pair of oscillation pieces 16, the present invention is not limited thereto. For example, according to a piezoelectric oscillator 10' of a second embodiment shown in FIG. 3, a pair of oscillation controlling pieces 16', each having a plurality of sections 16*a*, 16*b* and 16*c*, are used alternatively to the pair of oscillation controlling pieces 16 described above, the remaining portions of which are substantially the same as the former embodiment. It will be apparent to a person with ordinary skill in the art that the oscillation controlling piece 16' of the second embodiment has, as a whole, a function the same as that of the oscillation controlling piece 16 shown FIG. 1 even though it is divided into the plurality of sections 16*a*, 16*b* and 16*c*.

Figure 4:
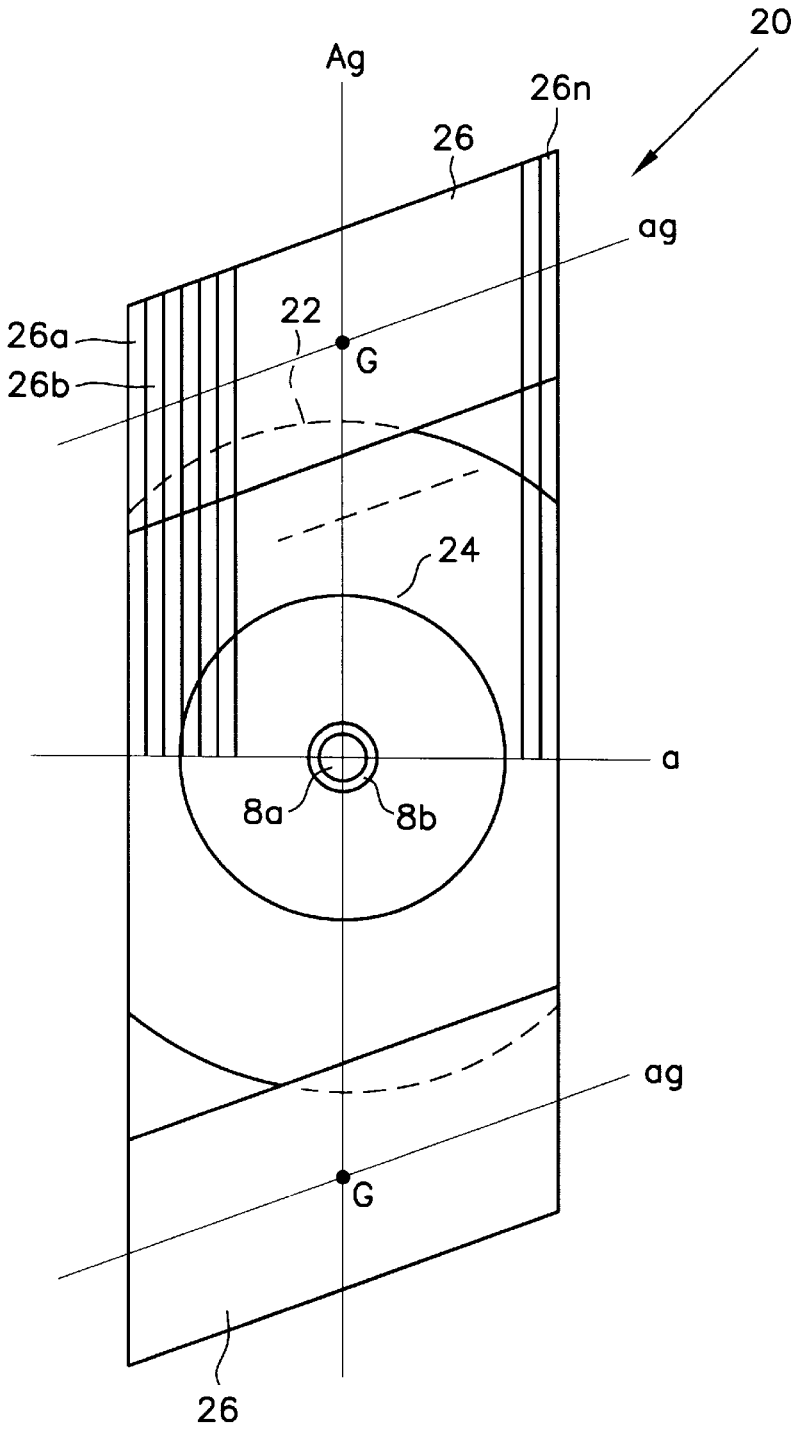
FIG. 4 is a plan view of a piezoelectric oscillator according to a third embodiment of the present invention.

Next, with reference to FIG. 4, a piezoelectric oscillator 20 according to a third embodiment of the present invention has piezoelectric oscillation plate 22 carrying a piezoelectric element layer on each of opposite surfaces thereof. A pair of parallelogram-shaped oscillation controlling pieces 26 are fixed to opposite ends of the piezoelectric oscillation plate 22. The oscillation controlling piece 26 is formed of the same material as that of the oscillation controlling piece 16 shown in FIG. 1.

In FIG. 4, an axis "a" of the piezoelectric oscillator 20 passes through a center of the piezoelectric oscillation plate 22 and is perpendicular to another axis "$a_g$" connecting the centers of gravity of the pair of oscillation controlling pieces 26 to each other. The oscillation controlling piece 26 is of a parallelogram-shape, which can be considered a configuration in which, providing a plurality of imaginary micro-subsections 26*a*, 26*b*, . . . 26*n* which are divided by straight line perpendicular to the axis "a", the distance between the axis "$a_g$" passing through centers of mass of the respective subsections 26*a*, 26*b*, . . . , 26*n* and the axis "a" varies along the axis "a". According to the structure, it is believed that the vibration of the piezoelectric oscillation plate 22 is suppressed by an infinite number of micro-subsections, each of which has the same mass and a position of a center of mass of which varies relative to the axis "a", whereby various oscillation modes are controllable.

A fourth embodiment of the present invention will be described below with reference to FIGS. 5 and 6. In this embodiment, a piezoelectric oscillator 30 is provided with a circular piezoelectric oscillation plate 32 and a pair of oscillation controlling pieces 34 arranged in two regions of the piezoelectric oscillation plate 32 opposite to each other relative to a center thereof. The piezoelectric oscillation plate of the preceding embodiments has the piezoelectric element layer solely in a central area of the metallic disk of which the opposite side portions are cut off. Contrarily, the piezoelectric oscillation plate 32 of this embodiment has a piezoelectric element layer or a bimorph layer 32*b* formed generally all over each of opposite surfaces of the metallic disk 32*a*. A central portion of the piezoelectric oscillation plate 32 is secured to an acoustic oscillation plate 6 via a mounting assembly 36 consisting of a rod 36*a*, a nut 36*b* and a bracket 36*c*. Preferably, the bracket 36*c* is attached to the acoustic oscillation plate 6 with a suitable adhesive or a double-coated tape.

Further, on one surface of the piezoelectric oscillation plate 32 are mounted a pair of oscillation controlling pieces 34. In FIG. 5, the axis "a" of the piezoelectric oscillator 30 is a straight line passing through a center of the piezoelectric oscillation plate 32 and perpendicular to an axis "$a_g$" connecting centers of gravity of the pair of oscillation controlling pieces 34 to each other. In FIG. 5, the oscillation controlling piece 34 is generally of a trapezoidal or triangular shape similar to that shown in FIG. 1. Providing a plurality of micro-subsections 34*a*, 34*b*, . . . , 34*n* divided by imaginary straight lines perpendicular to the axis "a", the oscillation controlling piece 34 can be considered to be an assembly of these micro-subsections, which sizes vary along the axis "a". Accordingly, it is possible by using the piezoelectric oscillator 30 according to this embodiment to obtain a flat acoustic pressure characteristic over a wide frequency band without peaks at particular frequencies.

Also, the piezoelectric oscillation plate 32 of this embodiment has no peripheral region wherein the piezoelectric element layer is not provided as in the case of the piezoelectric oscillation plate 12 of the embodiment shown in FIG. 1, but, instead, the piezoelectric element layer 32*b* covers generally all over one surface of the metallic disk 32*a*. Accordingly, vibration different from that applied to the piezoelectric element layer by an electric signal is prevented from being generated in the peripheral region of the piezoelectric oscillation plate, which phenomenon occurs in the preceding embodiment wherein no piezoelectric element layer exists in the peripheral region of the piezoelectric oscillation plate, whereby a high fidelity regeneration of a sound source is achievable. Experimentally, a satisfactory characteristic was resulted even though no piezoelectric element layer exists in a narrow region of about 5% of a total area of the piezoelectric oscillation plate 32 along the outer periphery thereof.

Figure 3:
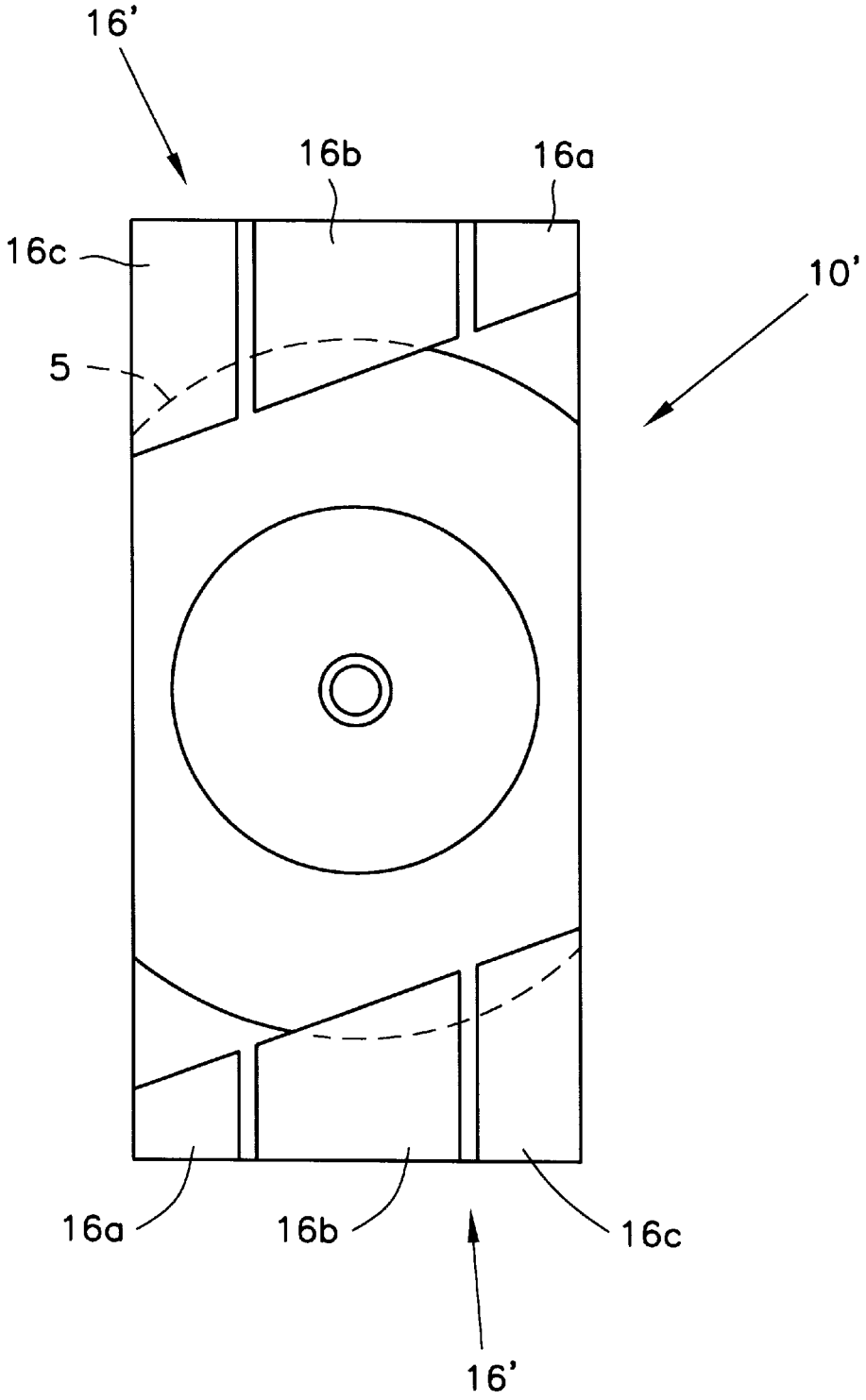
FIG. 3 is a plan view of a piezoelectric oscillator according to a second embodiment of the present invention.
Figure 5:
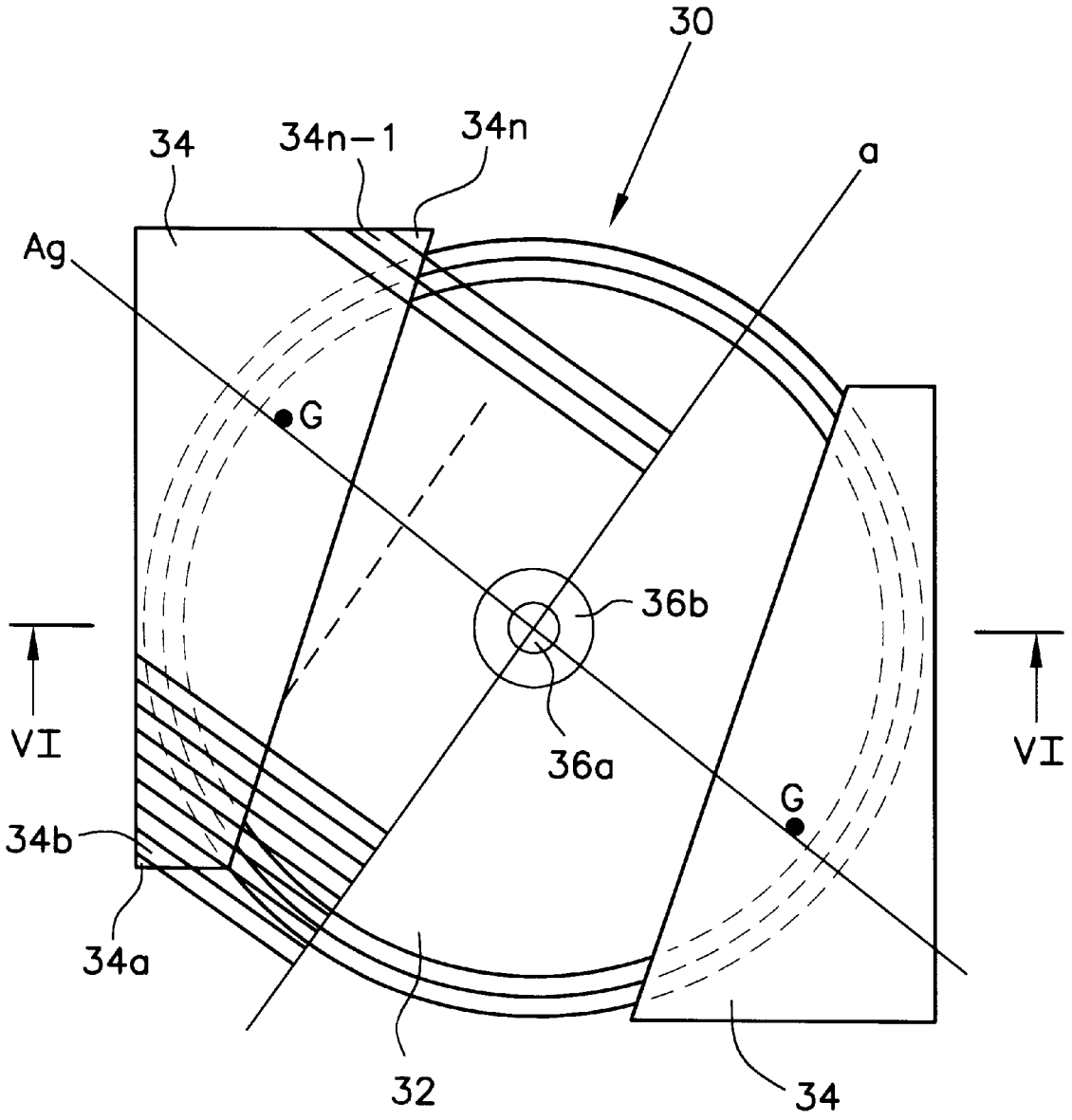
FIG. 5 is a plan view of a piezoelectric oscillator according to a fourth embodiment of the present invention.
Figure 6:
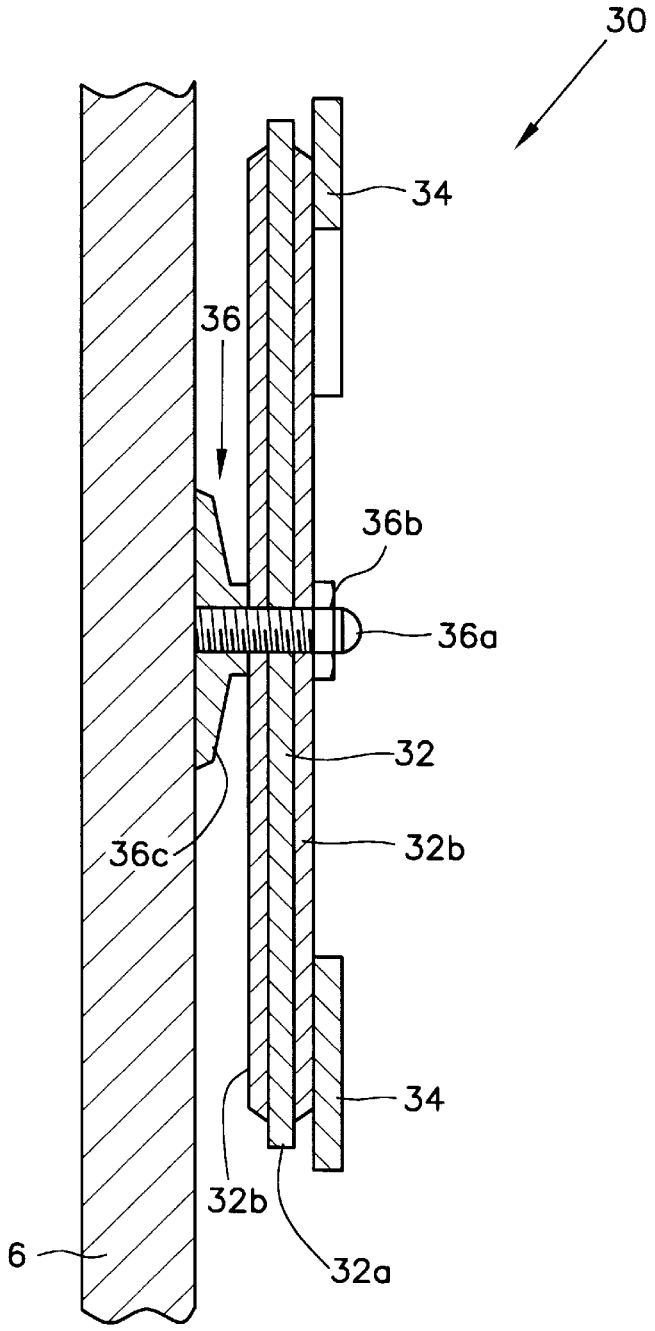
FIG. 6 is a sectional view of the piezoelectric oscillator attached to an oscillation plate of a speaker taken along a line VI—VI in FIG. 1.

Although the piezoelectric oscillator 30 shown in FIG. 5 is provided with the oscillation controlling piece 34 similar to the embodiment shown in FIG. 1, those shown in FIGS. 3 and 4 may be secured to the piezoelectric oscillation plate 32.

Next, a speaker using the piezoelectric oscillator according to the present invention will be described below.

Figure 7:
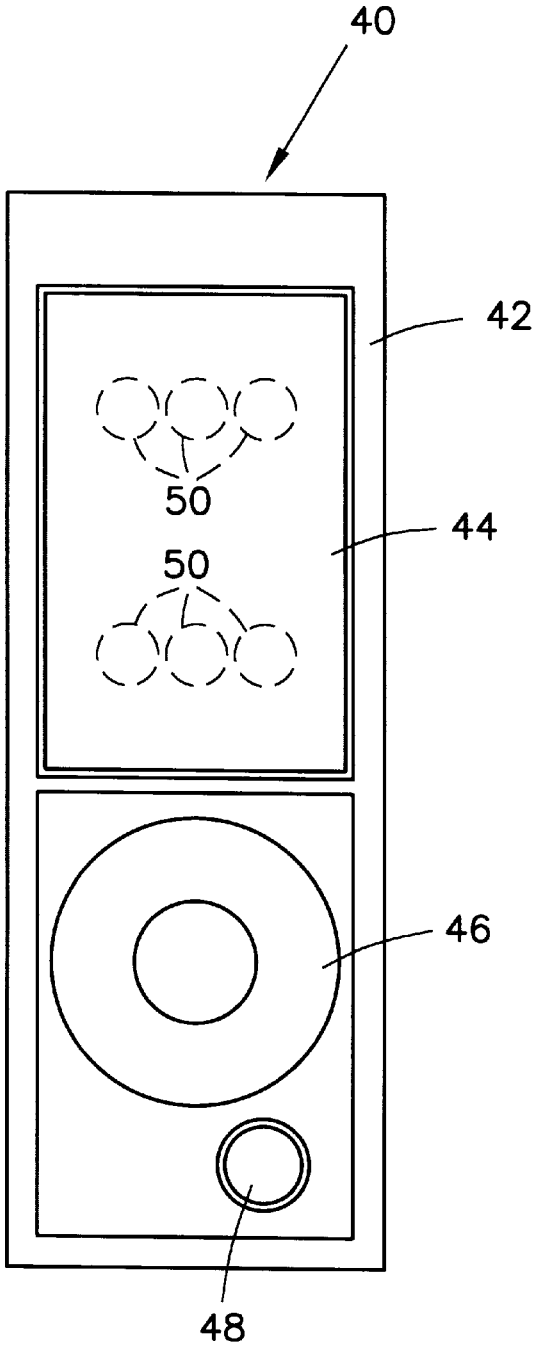
FIG. 7 is a front view of a favorable embodiment of a speaker using a piezoelectric oscillator according to the present invention.
Figure 8:
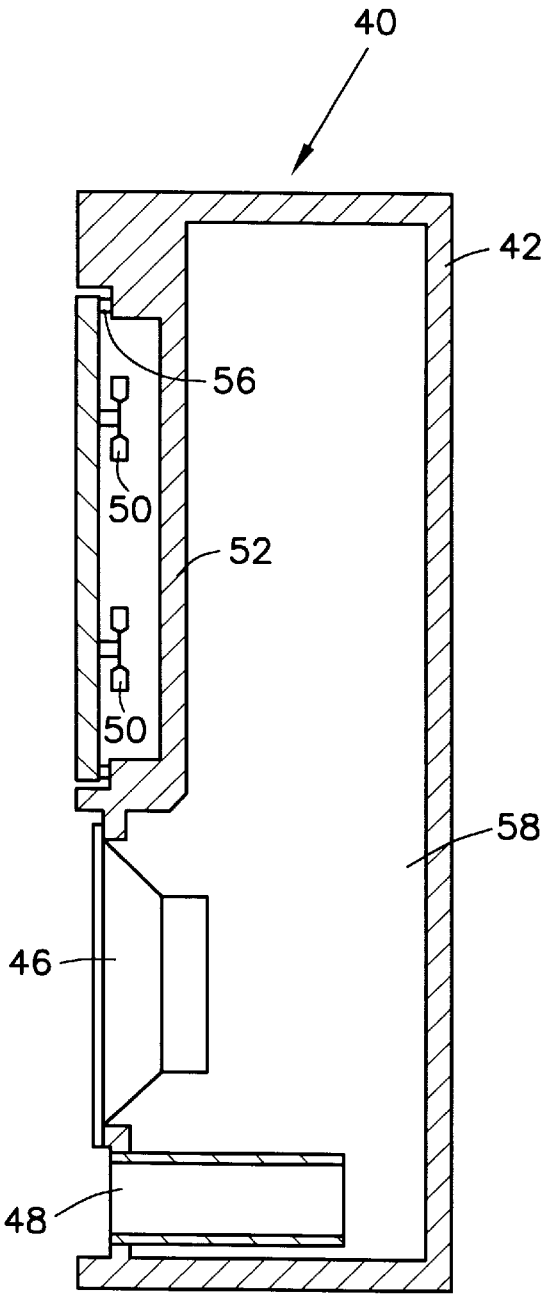
FIG. 8 is a side sectional view of the speaker shown in FIG. 7.

With reference to FIGS. 7 and 8, a speaker 40 is provided with a speaker box 42 having a dynamic speaker 46 for the bass range, a duct 48, a thin-walled flat plate-like acoustic oscillation plate 44 and one or more piezoelectric oscillators 50 arranged the spaces between each other on a back surface of the acoustic oscillation plate 44. The acoustic oscillation plate 44 may be formed of a fiber-reinforced plastic or a laminated plate wherein expanded polystyrene foam is sandwiched between a pair of plastic plates. The piezoelectric oscillator 50 may be the above-mentioned piezoelectric oscillators 10, 20, 30 and 40.

The interior of the speaker box 42 is completely partitioned into a larger capacity chamber 58 and a smaller capacity chamber 54 by a baffle 52. The larger capacity chamber 58 communicates with outer air via the duct 48, and therefore, regarding the dynamic speaker 46, it is of a bass flex type structure. On the other hand, the peripheral portion of the acoustic oscillation plate 44 is held by the speaker box 42 via an elastic member 56, so that the smaller capacity chamber 54 is substantially a sealed space.

Figure 9:
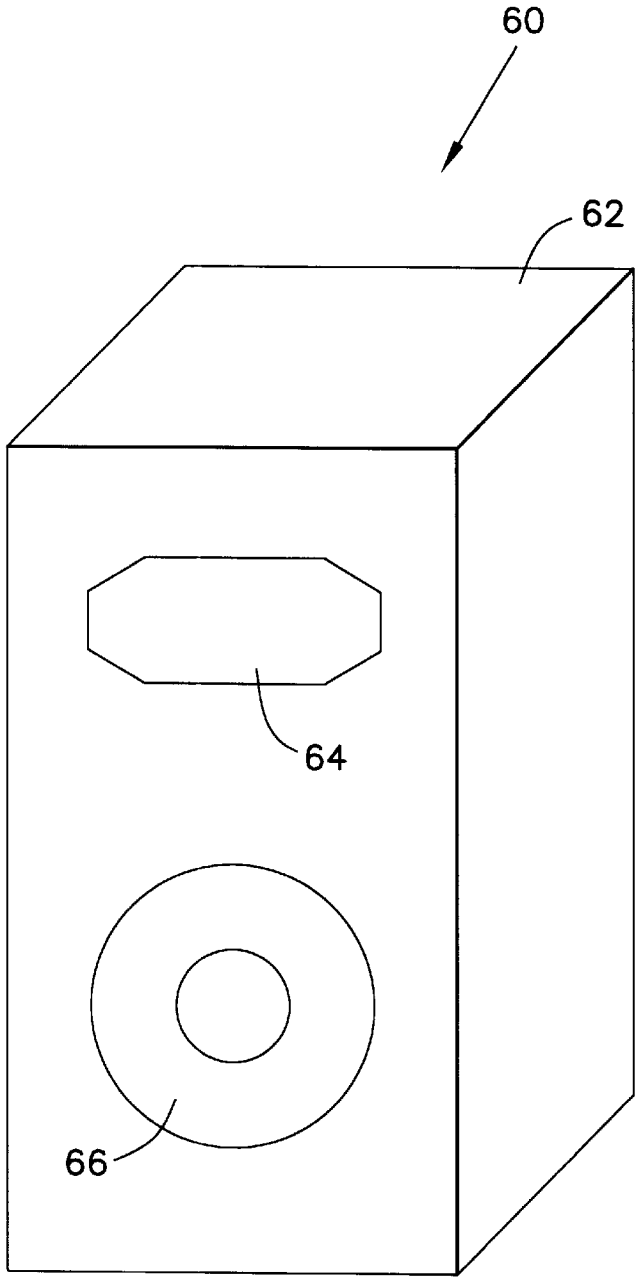
FIG. 9 is a schematic perspective view of another embodiment of a speaker using a piezoelectric oscillator according to the present invention.
Figure 10:
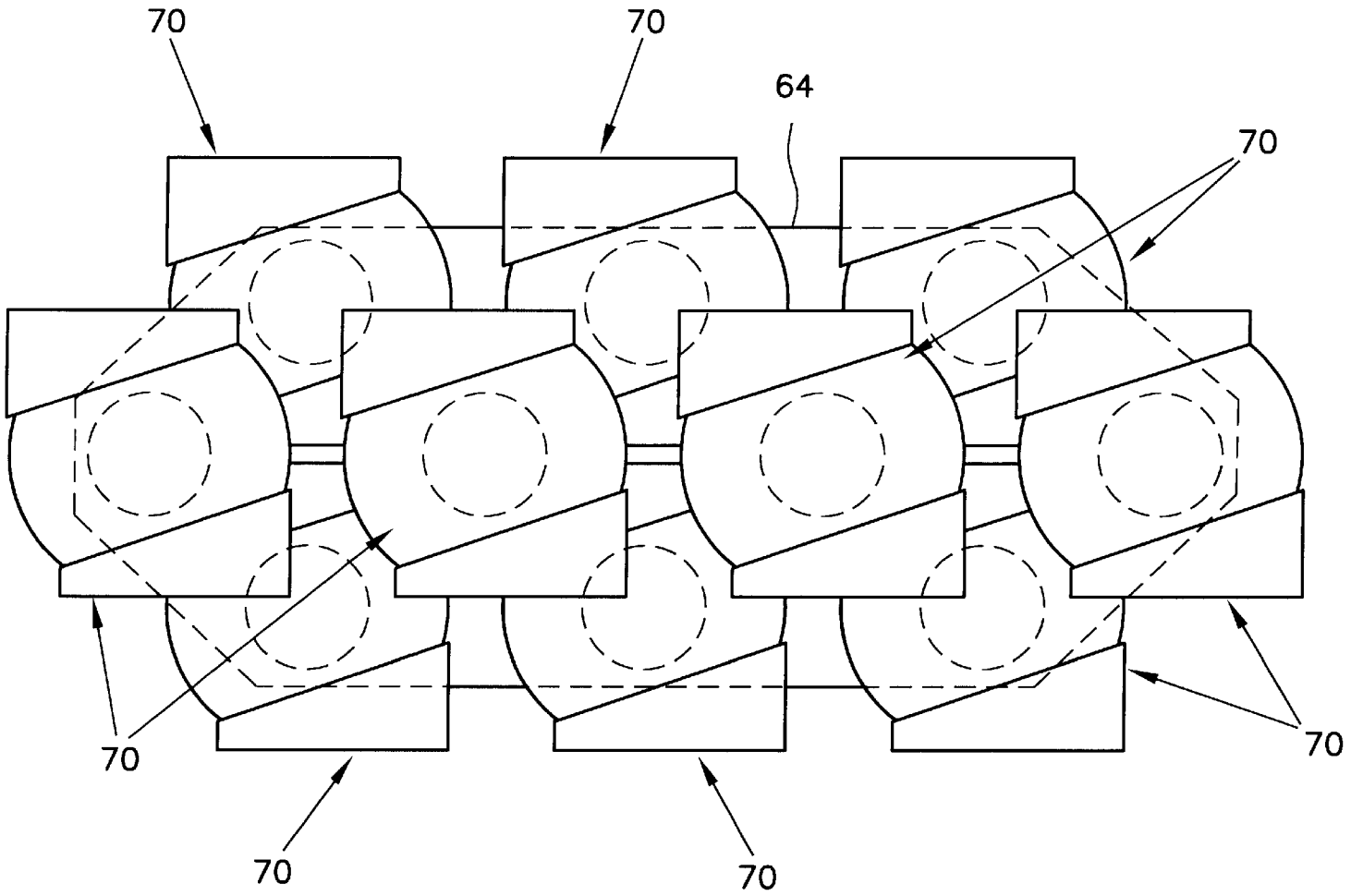
FIG. 10 is a back view of an acoustic oscillation plate used in the speaker of FIG. 9, illustrating the piezoelectric oscillators arranged on the acoustic oscillation plate and overlapped with each other.

Another embodiment of a speaker according to the present invention will be described with reference to FIGS. 9 and 10. A speaker 60 of this embodiment is provided with a speaker box 32, on which front surface are arranged an acoustic oscillation plate 64 for regenerating a medium and treble range and a dynamic speaker 66 for regenerating a bass range. The acoustic oscillation plate 64 may be formed in a similar manner as in the embodiment shown in FIGS. 7 and 8. On a back surface of the acoustic oscillation plate 64, a plurality of piezoelectric oscillators 70 are arranged in an overlapped relationship between each other. Particularly, in an aspect shown in FIG. 10, ten piezoelectric oscillators 70 are arranged side by side in three lateral rows. Of them, four piezoelectric oscillators located in a middle row are farther from the acoustic oscillation plate 64 than the others, so that the ten piezoelectric oscillators 70 at a higher density on the back surface of the acoustic oscillation plate 64 than that of the embodiment shown in FIGS. 7 and 8, whereby a sound pressure can be increased, particularly in a medium and treble range. While the piezoelectric oscillators 70 are directly mounted to the back surface of the acoustic oscillation plate 64 in this embodiment, a suitable member may be interposed between the piezoelectric oscillator and the acoustic oscillation plate.

Since the piezoelectric oscillators 50 and 70 have a good response characteristic to electric signals in the medium and treble range, i.e., in a frequency range from 500 Hz to 20 kHz, it is possible to regenerate high musical quality medium and treble sound having a high sound pressure if the acoustic oscillation plate 44, 64 is made to vibrate by the piezoelectric oscillation plate 50, 70. Meanwhile, by using the dynamic speaker 46, 66, high musical quality bass sound having a high sound pressure is obtainable.

As is apparent from the above description, according to the present invention, the frequency characteristic of a speaker becomes flat in a wider range and a high sound pressure is obtainable over all the frequency band from a bass range to a treble range.

What is claimed is:

1. A piezoelectric oscillator wherein an oscillation controlling piece of elastomer is attached to the periphery of a piezoelectric oscillation plate, characterized in that the oscillation controlling piece is shaped so that a distance between an axis passing through a center of the piezoelectric oscillation plate, which is perpendicular to a straight line connecting a center of the piezoelectric oscillation plate to the center gravity of the oscillation controlling piece, and a mass center line of the oscillation controlling piece varies along the axis.

2. A piezoelectric oscillator as defined by claim 1, wherein the piezoelectric oscillator is covered with a piezoelectric element layer generally all over each of the opposite surfaces of a metallic disk.

3. A speaker wherein a dynamic speaker for a bass sound and an acoustic oscillation plate for generating a medium and treble sound are accommodated in a speaker box; the acoustic oscillation plate being made to vibrate by the piezoelectric oscillation plate defined by claim 1.

4. A speaker as defined by claim 3, wherein the acoustic oscillation plate is a thin-walled flat plate held by the speaker box via an elastic member, and carries the piezoelectric oscillation plates on a back surface thereof with a space between each plate.

5. A speaker as defined by claim 3, wherein the piezoelectric oscillators are arranged on the back surface of the acoustic oscillation plate and overlapped with each other.

6. A piezoelectric oscillator wherein an oscillation controlling piece of elastomer is attached to the periphery of a piezoelectric oscillation plate, characterized in that the oscillation controlling piece is shaped so that a mass of each of sections of the oscillation controlling piece divided by a plurality of straight lines parallel to a straight line connecting a center of the piezoelectric oscillation plate to the center of gravity of the oscillation controlling piece varies along an axis which is perpendicular to the straight line and passes by the center of the piezoelectric oscillation plate.

7. A piezoelectric oscillator as defined by claim 6, wherein the piezoelectric oscillator is covered with a piezoelectric element layer generally all over each of the opposite surfaces of a metallic disk.

8. A speaker wherein a dynamic speaker for a bass sound and an acoustic oscillation plate for generating a medium and treble sound are accommodated in a speaker box; the acoustic oscillation plate being made to vibrate by a piezoelectric oscillation plate defined by claim 6.

* * * * *